US005694657A

United States Patent [19]

Yoshida et al.

[11] Patent Number: 5,694,657

[45] Date of Patent: Dec. 9, 1997

[54] REGENERATING APPARATUS OF RECORDING MEDIUM

[75] Inventors: Masazumi Yoshida, Amagasaki; Junji Machida; Kaoru Furusawa, both of Toyonaka; Haruhiko Atarashi, Fujiidera, all of Japan

[73] Assignee: Minolta Co., Ltd., Osaka, Japan

[21] Appl. No.: 330,321

[22] Filed: Oct. 27, 1994

[30] Foreign Application Priority Data

Oct. 28, 1993 [JP] Japan ..... 5-270352
Oct. 28, 1993 [JP] Japan ..... 5-270354

[51] Int. Cl.[6] ..... A47L 25/00

[52] U.S. Cl. ..... 15/88.3; 15/4; 15/77; 15/302; 134/122 R

[58] Field of Search ..... 15/77, 88.3, 100, 15/102, 302; 354/320, 321, 322; 134/64 R, 64 P, 122 R, 122 P

[56] References Cited

U.S. PATENT DOCUMENTS 3,382,520 5/1968 Savart ..... 15/77
4,475,259 10/1984 Ishii et al. ..... 15/77
4,942,421 7/1990 Gumbinner ..... 15/77
5,400,123 3/1995 Sato et al. ..... 15/77

FOREIGN PATENT DOCUMENTS 4-91298 3/1992 Japan .
4-300395 10/1992 Japan .

*Primary Examiner*—Timothy F. Simone
*Assistant Examiner*—Randall E. Chin
*Attorney, Agent, or Firm*—Brinks Hofer Gilson & Lione

[57] ABSTRACT

A regenerating apparatus of a recording medium by removing a printing material therefrom comprises a holder which is arranged in the liquid and has a plurality of holding members for holding the media; a feeder for feeding the medium to the respective holding members successively; a discharger which includes a discharging passage extending from each of the holding member and out of the liquid for discharging the recording medium having been held by the holding member for a specific time; and a remover which is disposed in the liquid and near the passage so as to contact and remove the printing material from the recording medium transported along the passage.

12 Claims, 7 Drawing Sheets

REGENERATING APPARATUS OF RECORDING MEDIUM

BACKGROUND OF THE INVENTION

1. Field of the Invention

The present invention relates to a regenerating apparatus of recording medium for removing the printing material by applying a special cleaning liquid to the recording medium such as paper having images printed by the image forming apparatus such as copiers and printers.

2. Description of the Prior Art

Conventionally, as a regenerating apparatus for removing a toner from a recording paper having images printed by image forming equipment such as copiers, etc., Japanese Patent Laid-Open Publication discloses an apparatus in which the recording paper is immersed in a cleaning liquid such as a diapersant so that a printing material or toner image is liberated and then removed therefrom.

In this wet type regenerating apparatus as described above, the recording medium must be immersed in the cleaning liquid until the printing material could be readily removed, which restricts the amount of recording medium to be treated at the same time.

Also, the recording paper from which the toner is removed still contains a large amount of water or dispersant which must be removed by heating and drying it. However, if the water or dispersant is evaporated into a steam and all the steam is released into the atmosphere, the working environment will become worse and the dispersant must be supplied frequently.

SUMMARY OF THE INVENTION

It is therefore an object of the present invention to provide an improved regenerating apparatus which is capable of treating a large amount of recording medium simultaneously.

Another object of the present invention is to provide a regenerating apparatus which is capable of recovering a steam of water and dispersant so as to keep the working environment clean.

The above and other objects are accomplished by the present invention which comprises a container accommodating a liquid for swelling the printing material; a holding mechanism which is arranged in the liquid and has a plurality of holding members for holding the recording medium; a supplying mechanism which feeds the recording medium to the respective holding members successively; a discharging mechanism which includes a discharging passage extending from each of the holding members and out of the liquid for discharging the recording medium having been held by the holding member for a specific time; and a removing member which is disposed in the liquid and near the passage so as to contact and remove the printing material from the recording medium transported along the passage.

Preferably the holding member comprises a chamber and the chambers of respective holding members are arranged in layers, and further each chamber holds the recording medium with keeping the recording medium from touching the other.

In another aspect of the invention, the invention comprises a transporting mechanism which has a passage for transporting the recording medium, a removing mechanism which applies a cleaning liquid to remove the printing material from the recording medium which is transported along the passage, a drying mechanism which drys the recording medium which has been applied with the cleaning liquid, and a recovering mechanism which receives a moisture of the liquid generated when the recording member is dried by the drying mechanism.

Preferably, the regenerating apparatus further comprises a returning mechanism which returns the liquid recovered by the recovering mechanism to the removing mechanism.

BRIEF DESCRIPTION OF THE DRAWINGS

These and other objects and features of the present invention will become clear from the following description taken in conjunction with preferred embodiments thereof with reference to the accompanying drawings throughout which like parts are designated by like reference numerals, and in which.

DETAILED DESCRIPTION OF THE PREFERRED EMBODIMENTS

Figure 1:
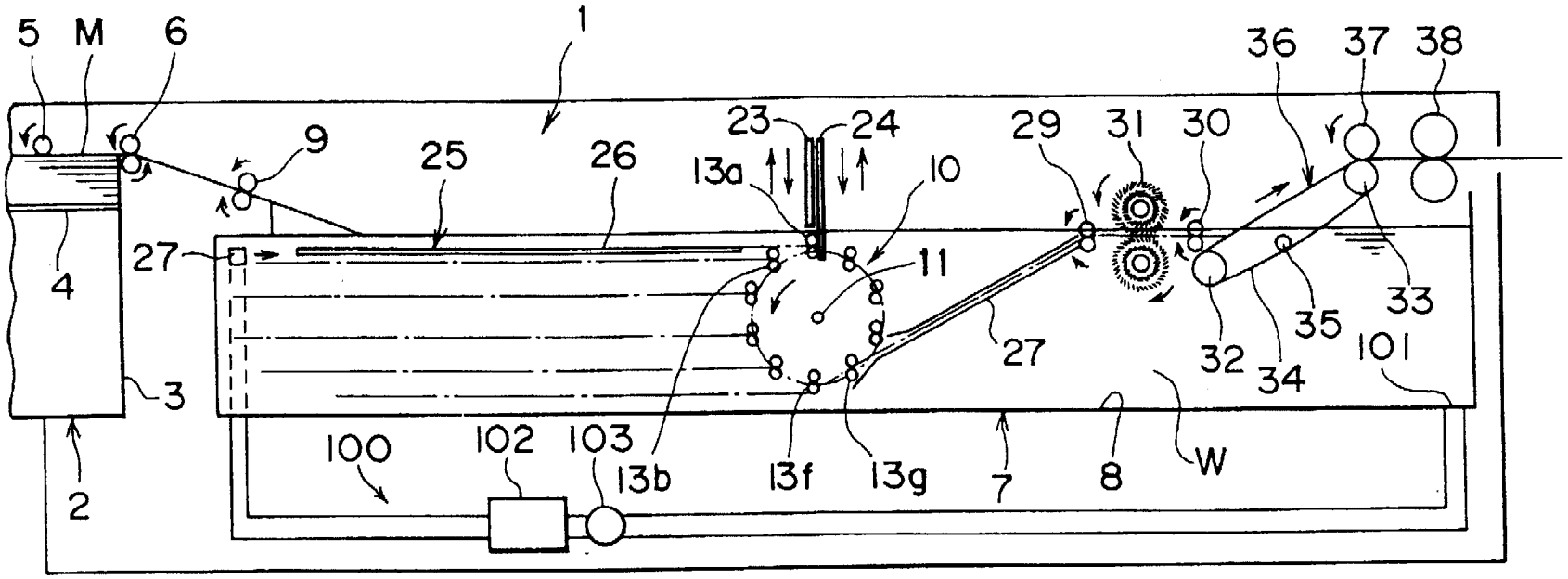
FIG. 1 is a cross sectional plan view showing a general configuration of the regenerating apparatus according to the first embodiment.

Referring now to the drawings, there is shown in FIG. 1 a general view of a wet type regenerating apparatus which removes a printing material such as toner from a recording medium such as paper or film of overhead projector (OHP) with images printed and regenerates the recording medium into a recyclable condition. The regenerating apparatus 1 comprises a feeder unit generally indicated by reference numeral 2 which is capable of housing a plurality of recording medium M to be treated in layers, and a cleaning unit generally indicated by reference numeral 7 which removes the printing material from the recording medium M fed by the feeder 2.

The feeder unit 2 includes a container 3 in the form of box, a bottom plate 4 that moves up and down in this container 3 and supports thereon a plurality of recording media M in layers, a feed roller 5 that comes in contact with the upper surface of uppermost recording medium M and then sends out the same according to its rotation, and a pair of rollers 6 for separating the uppermost recording medium from the lower one in order to prevent a double feed of the recording medium M.

The cleaning unit 7 includes a container 8 for accommodating a cleaning liquid W which will be discussed later and a pair of guide rollers 9 for introducing the recording medium M fed from the feeder 2 into the cleaning liquid W, and at nearly the center of the container 8, a holding unit 10 is installed for holding the recording medium M in the cleaning liquid W for a specified time.

Figure 2:
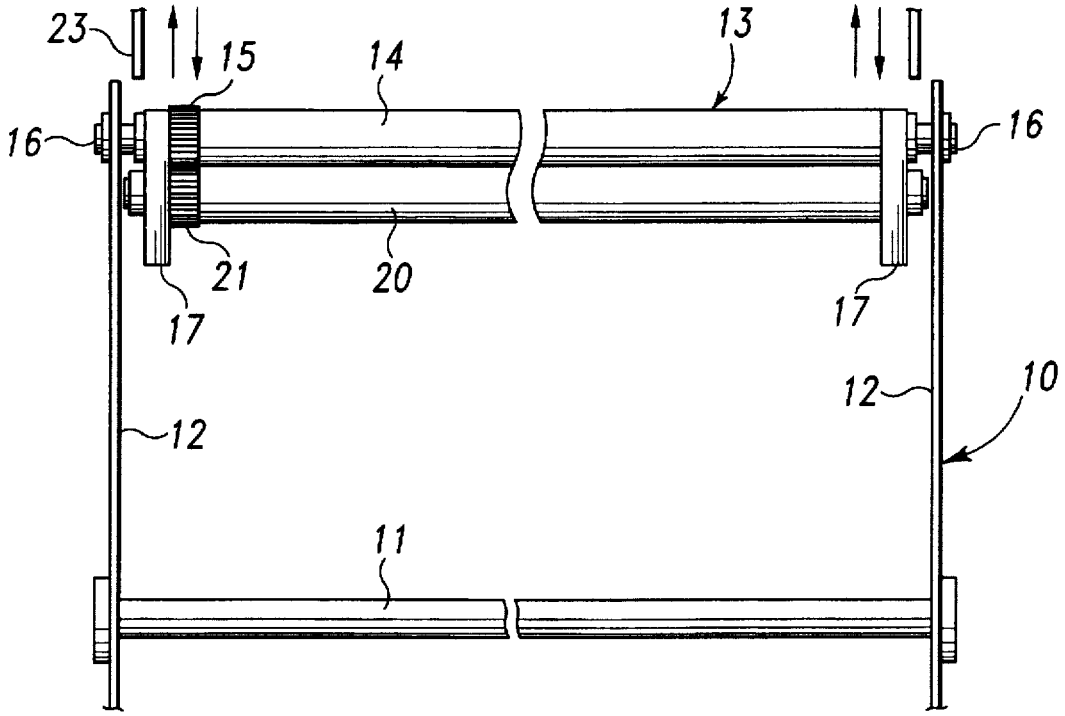
FIG. 2 is a fragmentary view of the holding device.

The holding unit 10, as shown in FIG. 2, extends in the direction perpendicular to the travelling direction of the recording medium M and is equipped with a rotating shaft 11 drivingly connected with the motor not illustrated and pair of opposing frames 12 fixed at both ends of the rotating shaft 11, respectively, and has a plurality, e.g., ten sets in this embodiment, of chucking mechanisms generally indicated by reference numeral 13 for chucking and holding the front portion of the recording medium M with respect to the travelling direction thereof. These chucking mechanisms 13 are arranged at equal intervals on the circumference of a specified radius having its center at the rotating shaft 11.

Figure 3:
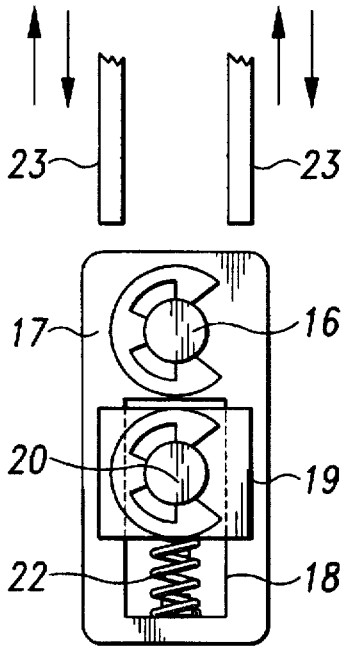
FIG. 3 is a side view of the chuck mechanism.
Figure 4:
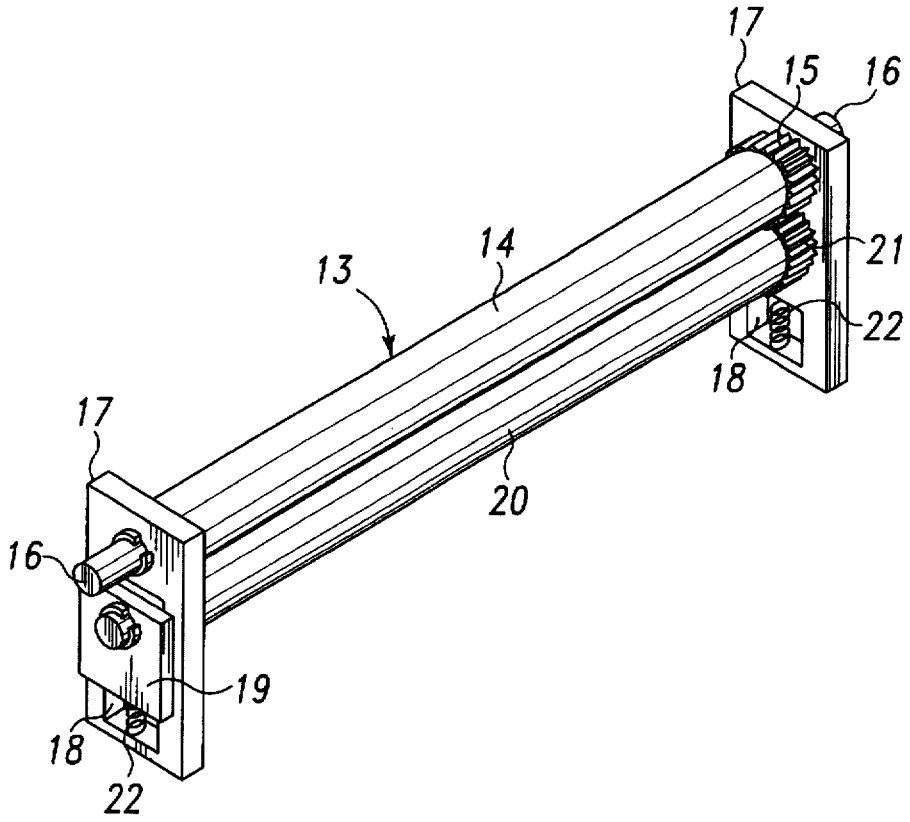
FIG. 4 is a perspective view of the chuck mechanism.

Each chucking mechanism 13, as shown in FIGS. 3 and 4, includes an upper roller 14 having a gear 15 at one end thereof and a pair of first supporting plates 17 rotatably mounted at respective ends of a shaft 16 of the roller 14. The supporting plate 17 has an elongated hole 18 extending towards the shaft 16. Arranged outside the first supporting plates 17 are second supporting plates 19, respectively, which are capable of moving vertically along the elongated hole 18. These second supporting plates 19 cooperate to rotatably support a lower roller 20 having a gear 21 at one end thereof. Each second supporting plate 19 is biased upwardly by a spring arranged in the elongated hole 18 so that the lower roller 20 is brought into contact with the upper roller 14, and the gears 15 and 21 thereof are engaged with each other.

The chucking mechanism 13 is supported by the side frames 12 with both ends of the shaft 16 of the upper roller 14 rotatably hung on the side frames 12 so that the upper and lower rollers 14 and 20 move while keeping their relative positions, i.e., upper and lower relationship according to the rotation of the side frames 12.

Referring back to FIG.1, a pair of biasing members 23 are disposed above the center of the side frames 12, respectively. These members 23 move simultaneously in the direction indicated by arrows so as to press down the second supporting plates 19 of the chucking mechanism 13*a* that reaches the uppermost position in accordance with the rotation of the shaft 11, thereby causing the lower roller 20 to separate from the upper roller 14 and make a space therebetween. Also arranged above the chucking mechanism 13 is a regulating plate 24 which is capable of moving upward and downward on the discharge side i.e., right side of the chucking mechanism 13*a*, such that when the recording medium M is transported based on the rotation of the rollers 9 and then inserted into the space between the upper and lower rollers 14 and 20 separated by the members 23, it is regulated at the front edge thereof by the regulating plate 24 to stop. Further, a sensor not shown is provided to detect a condition that the front edge of the recording medium M comes in contact with the regulating plate 24.

When the sensor detects this contact condition, both the biasing member 23 and the regulating plate 24 moves above the container 8 so as not to interfere with the movement of the chucking mechanisms 13. In the vicinity of the chucking mechanism 13*g* illustrated in the downstream position of the chucking mechanism 13*f* illustrated at the lowermost position with respect to the movement of each chucking mechanisms 13, a driving gear, not shown, which engages the gear 15 or 21 is provided so that the recording medium M chucked by the upper and lower rollers 14 and 20 is forwarded to the discharge side in accordance with the rotation of the driving gear.

Figure 5:
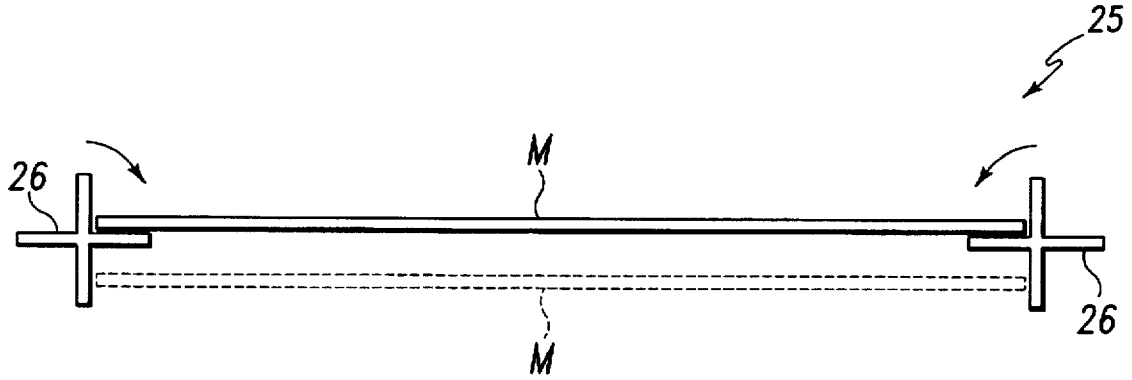
FIG. 5 is a front view of the recording medium support member.

On the charge side, i.e., left side, of the chucking mechanism 13*a* located at the uppermost position, a supporting mechanism 25 is provided for temporarily supporting both side edges of the recording medium M conveyed in the cleaning liquid W on a horizontal surface. This supporting mechanism 25 has two elongated support members 26 having a cross section in the form of plus, i.e., (+), as shown in FIG. 5. These supporting members 26 are arranged in parallel along the travelling direction of the recording medium M and are designed to rotate in the respective arrow directions by the driving source not illustrated.

On the charge side of the container 8, a nozzle 27 connected to a device generally indicated by reference numeral 100 for circulating the cleaning liquid is arranged. This nozzle 27 is designed to spout out the cleaning liquid W in the arrow direction towards the bottom surface of the recording medium supported by the supporting members 26 in the cleaning liquid W. The cleaning liquid circulating device 100 comprises a liquid inlet 101, a pump 102, and a filter 103 as to spout out the liquid W sucked from the liquid inlet 101 towards the recording medium M through the nozzle 27, such that the recording medium M immersed in the cleaning liquid W advances by the stream of the liquid W in the discharge direction.

On the discharge side of the chucking mechanisms 13, there is provided a guide 28 of the recording medium M, which extends diagonally upward towards the surface of the cleaning liquid W from the vicinity of the chucking mechanism 13*g*. On the discharge side of the guide 28, two pairs of rollers 29 and 30 are arranged below the surface of the cleaning liquid W with leaving a specified clearance therebetween. Between these pairs 29 and 30, a pair of brush rollers 31 are disposed so as to be in contact with the respective surfaces of the recording medium M, thereby the printing material immersed and then swollen in the cleaning liquid W is removed from the medium M by the contact of the brush rollers 31. On the discharge side of the rollers 30, a conveyor generally indicated by reference numeral 36 is arranged. This conveyor 36 includes a belt 34, preferably made of fluoro-rubber, entrained about two rollers 32 and 33 and a tension thereof is adjusted with a tension roller 35, so that the recording medium M moving past the rollers 30 is taken out from the cleaning liquid W with the conveyor 36.

A squeeze roller 37 is arranged to contact with the roller 33 positioned on the discharge side in the conveyor 36 through the belt 34, so that the water or the cleaning liquid is squeezed out from the recording medium M which is taken out from the cleaning liquid W. On the discharge side of the conveyor 36, a heating unit 38 which is composed of two rollers made of aluminum having heaters is mounted to heat and dry the swollen recording medium M to a specified dried condition.

In operation, the uppermost recording medium M in the container 3 of the feeder unit 2 is fed by the feeding roller 5 and the separating rollers 6 and then introduced into the cleaning liquid W with the guide rollers 9. Next, the recording medium M is supported at its both sides by the support members 26. Also, the recording medium M is conveyed towards the holding unit 10 without dropping from the support members 26 by the stream of the cleaning liquid M spouted out from the nozzle 27. At this time, the regulating plate 24 and the biasing members 23 are located at the lowermost position, that is, the regulating plate 24 protrudes on the discharge side of the chucking mechanism 13*a* located at the uppermost position and the biasing members 23 press down the respective second supporting plates 19 of the chucking mechanism 13*a* to separate the lower roller 20 from the upper roller 14. Therefore, the front portion of the recording medium M approaching the holding unit 10 along the supporting members 26 is introduced between the upper and lower rollers 14 and 20 and then comes in contact with the regulating plate 24 to be positioned at the specified position. When the sensor detects that the recording medium M has entered the clearance between the rollers 14 and 20, the biasing members 23 start rising to hold the recording medium M between the rollers 14 and 20. As soon as the biasing members 23 rise, or in synchronism with the operation thereof, the regulating plate 24 rises and moves away from the moving path of the chucking mechanisms 13.

Then, the side frames 12 rotate 36 degrees in the arrow direction, and thereby the chucking mechanism 13*a* which holds the recording medium M between rollers 14 and 20 moves to a subsequent position indicated by reference numeral 13*b*. Simultaneously with this motion, the supporting members 26 rotate 90 degrees in the arrow direction, respectively, as shown in FIG.5, so as to move the recording medium M at the position shown in dotted line.

Thereafter, in a similar manner, the biasing members 23 and regulating plate 24 work against the chucking mechanism 13*a* which has newly positioned at the uppermost position and make the rollers 14 and 20 hold the subsequent recording medium M conveyed by the feeding unit 2 between rollers 14 and 20.

As described above, the recording medium M held between rollers 14 and 20 is retained in the cleaning liquid W while the chucking mechanism 13 holding the same is located from the uppermost position (13*a*) to the lowermost position (13*f*), during which the printing material in contact with the cleaning liquid W swells and dissolves so as to be readily removed by light rubbing. When the chucking mechanism 13*f* located at the lowermost position moves 36 degrees in the arrow direction therefrom, the gear 15 or 21 engages with the driving gear, which causing the rollers 14 and 20 to rotate in the different directions, respectively, and thereby advancing the recording medium M to the discharge side along the guide 28.

The recording medium M moving past the guide 28 is conveyed to the brush rollers 31 through the rollers 29, and the swollen or dissolved printing material is scratched away with this brush rollers 31. It is desirable to rotate the brush rollers 31 so that the circumferential speed thereof is higher than that of the recording medium M transported by the rollers 29 and 30.

Next, the recording medium M from which the printing material has removed is transferred through the rollers 30 to the conveyor unit 36, by which it is taken out from the cleaning liquid W. The recording medium M is then transported between the squeeze rollers 37 where the cleaning liquid W contained in the medium M is squeezed out therefrom. Finally, the medium M is heated to be dried by the heating unit 38, and is discharged onto a tray not illustrated.

Figure 6:
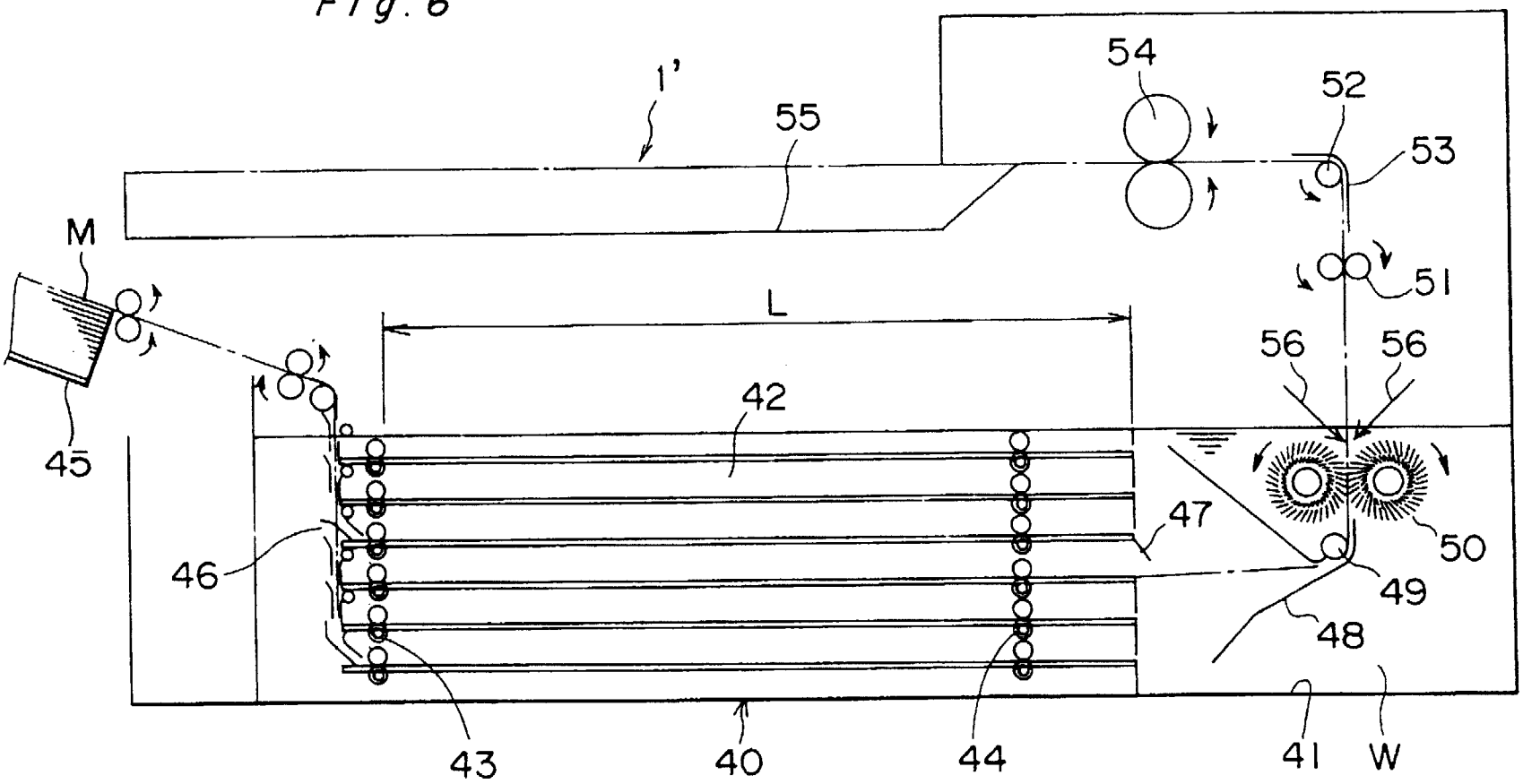
FIG. 6 is a cross sectional plan view showing a general configuration of the regenerating apparatus according to the second embodiment.

Referring to FIG. 6, in another embodiment of the present invention, the regenerating unit 1' comprises a plurality (e.g., six in this embodiment) of chambers 42 arranged in layers. Each chamber 42 has two pairs of rollers 43 and 44 at its charge and discharge sides, respectively. Also, the upper or lower roller of the pair 44 is so mounted as to separate from the other. The unit 1' also comprises passage selectors 46 on the charge side of respective chambers 42 for delivering the recording medium M from a feeding unit 45 to respective containers 42. On the other hand, each chamber 42 has a door 47 on its discharge side.

On the discharge side of the chamber 42, a guide 48 is mounted for guiding the recording medium M taken out from each chamber 42. On the discharge side of the guide 48, transfer rollers 49 are mounted. A pair of brush rollers 50 are installed above the transfer rollers 49, and a pair of squeezing rollers 51 are mounted above the brush roller pair 50. Further, transfer rollers 52 and a guide 53 for guiding the recording medium M conveyed from below to a horizontal direction are arranged above the squeezing rollers 51, and between this guide 53 and a discharge tray 55, a heater dryer 54 is installed.

In operation, the recording medium M fed by the feeding unit 45 is supplied one by one to the chambers 42 in sequential order from the uppermost one or from the lowermost one. The recording medium M in each chamber 42 is then transported towards the discharge side by the rollers 43, and when the rear edge of the recording medium M has moved past the rollers 43, the rollers complete the rotation thereof. Then, the recording medium M is retained still in the chamber 42 for a specific time. Note that when the recording medium M has been inserted into the chamber 42, the rollers 44 are kept apart so that the front portion of the medium M is inserted therebetween. It should be designed that the distance L from the rollers 43 to the door 47 is longer than the length of the maximum sheet to be treated. Also, at least one pair of rollers may be arranged between the rollers 43 and 44.

The recording medium M retained in the chamber 42 is fed out successively in order of storage. That is, the door 47 of the container 42 that stores the recording medium M is opened, and the rollers 44 nip the recording medium M and then send it out of the chamber 42 based on the rotation thereof. The recording medium M discharged from the chamber 42 is transported upward with the transfer roller 49 along the guide 48 and printing materials on both surfaces are removed with the brush rollers 50. It is desirable to install showers 56 for spraying the cleaning liquid W over the recording medium M above the brush roller pair 50 as illustrated. This is because the printing material immersed in the cleaning liquid W over a specified time can be readily removed by applying physical force and can be completely removed from the recording medium M with these brush roller pair 50 and shower 56.

Next, the recording medium M from which the printing material has been removed is squeezed by the squeezing rollers 51 to remove the water or cleaning liquid, fed to the heater dryer 54 by the transfer roller 52 and guide 53, where it is dried to the recyclable condition and finally discharged onto the discharge tray 55.

Figure 7:
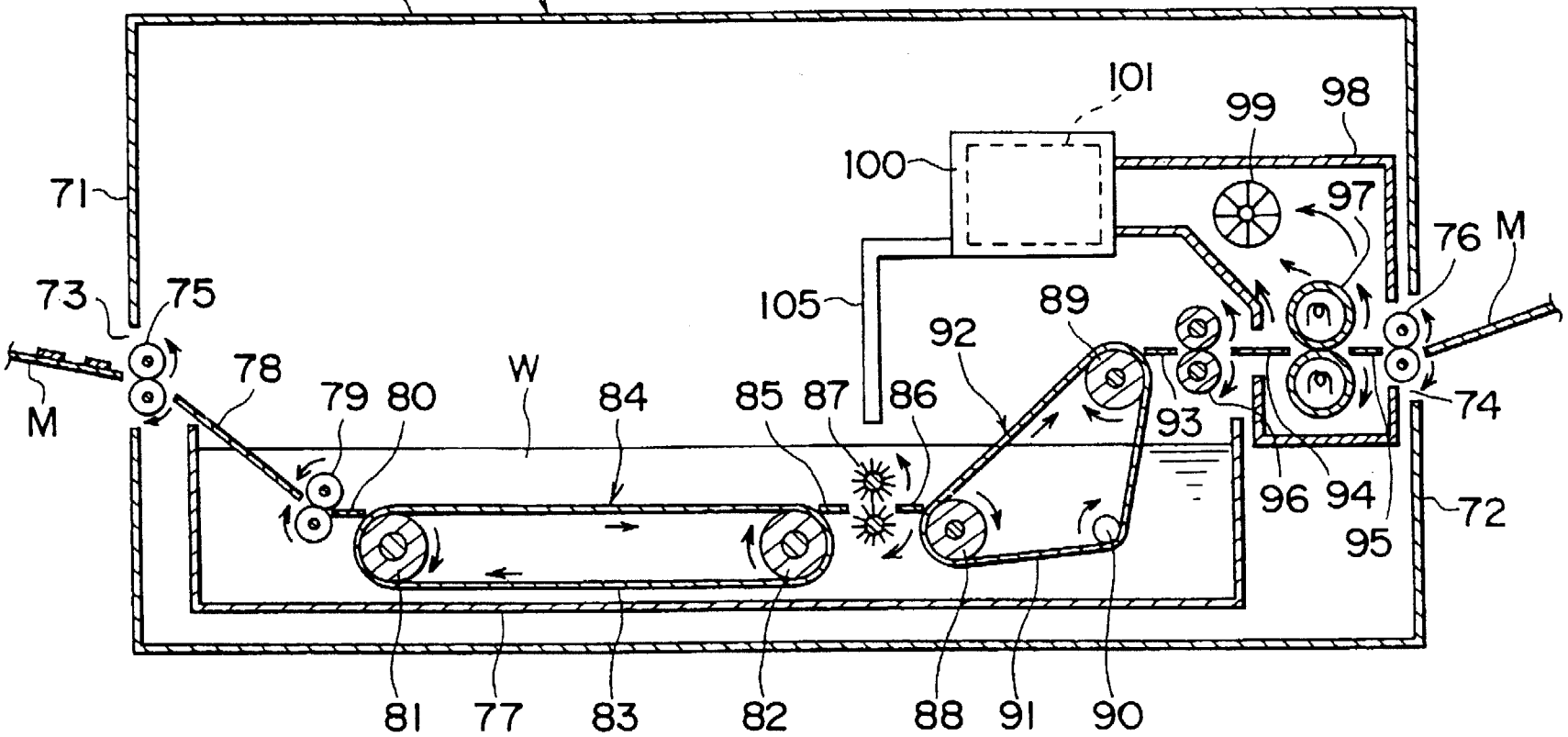
FIG. 7 is a cross sectional plan view showing a general configuration of the regenerating apparatus according to the third embodiment.

Referring to FIG. 7, in another embodiment of the present invention, a regenerating unit 1" comprises a housing 70 in the form of a box. The housing 70 has openings 73 and 74 in its charge side and discharge side walls, i.e., left side and right side walls 71 and 72 for feeding in and out the recording medium M, respectively. In the vicinity of the openings 73 and 74, a pair of charging rollers 75 and a pair of discharging rollers 76 are arranged, respectively.

The housing 70 includes therein a container 77 having an opening at its top in order to accommodate a cleaning liquid W for removing the printing material from the recording medium M. The container 77 includes therein an inclined guide plate 78 for guiding the recording medium M introduced into the housing 70 with the rollers 75, a pair of rollers 79 for transporting the recording medium M advancing on the guide plate 78 further to the discharge side, a guide plate 80 for directing the recording medium M moving past the roller pair 79 to the horizontal direction, a first conveyor generally indicated by reference numeral 84 which has a belt 83 entrained about a pair of rollers 81 and 82 facing each other on a horizontal surface for transporting the recording medium M in the cleaning liquid W, a pair of guide plates 85 and 86 for guiding the recording medium M delivered from the first conveyor 84, a pair of brush rollers 87 so located between the guide plates 85 and 86 as to slightly contact at their circumferences each other on a passage of the recording medium M, and a second conveyor generally indicated by reference numeral 92 which has a belt 91 entrained about three rollers 88, 89, and 90 for taking out the recording medium M from the cleaning liquid W.

Arranged about the container 77 on the discharge side are three guide plates 93, 94, and 95 for guiding the recording medium M taken out from the cleaning liquid W with the second conveyor 92 to a pair of discharge rollers 76, a pair of squeezing rollers 96 in contact with each other on the passage of the recording medium M between the guide plates 93 and 94 for squeezing out the cleaning liquid W contained in the recording medium M, and a pair of heat rollers 97 in contact with each other on the passage of the recording medium between the guide plates 94 and 95 for heating to dry the wet recording medium M to a recyclable condition.

Figure 8:
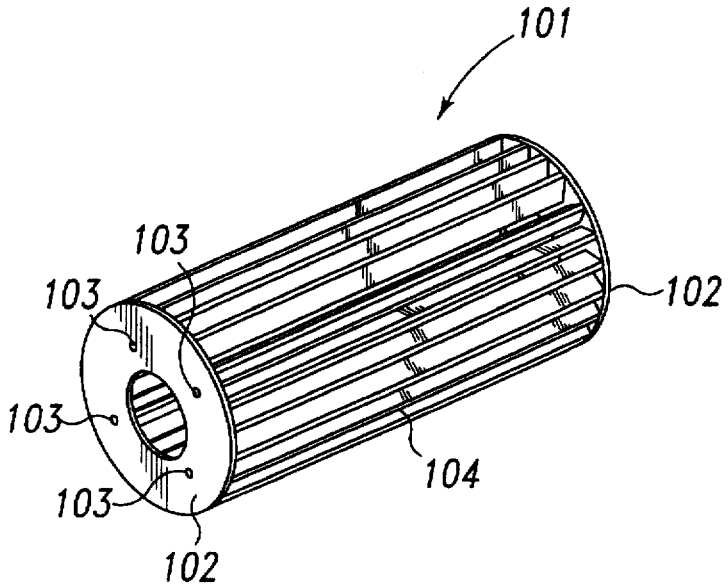
FIG. 8 is a perspective view of the device that adsorbs moisture in the recovery unit.

The pair of heat rollers 97 are almost sealed up with a sealing box 98. The sealing box 98 houses a suction fan 99 for sucking a steam generated at the heating of the swollen recording medium M and a steam from the cleaning liquid W and a recovery unit 100 for absorbing and recovering the moisture and the like fed by the suction fan 99. The recovery unit 100 comprises a recovering drum 101 shown in FIG. 8 which consists of a pair of opposing circular plates 102 connected by four rods 103 and recovering members 104 arranged between and along the circular plates 102 for absorbing the moisture. This drum 101 is supported by a shaft not shown arranged on the center line of the circular plates 102 and drivingly connected with the motor also not shown, such that, on the basis of an instruction of an operator or a starting signal which shows that the regenerating unit has operated for a specific time, the drum 101 starts its rotation and the liquid in the recovering member 104 is discharged towards a wall of the recovering unit 100. The recovery unit 100 also comprises an outlet 33 so that the liquid moved down along the wall is finally returned to the container 77 through an outlet 33.

In operation, the recording medium M fed into the housing 70 by the rollers 75 is introduced in the cleaning liquid W along the guide plate 78, delivered onto the guide plate 80 with the second rollers 79, transferred to the discharge side with the first conveyor 84, and then transported to the brush rollers 87 via the guide plate 85. The recording medium M transported to the position of the brush rollers 87 has the printing material already swollen or dissolved, that is, the printing material is in the condition readily removable with only applying physical force. Therefore, when the recording medium M moves past between the brush rollers 87, the printing material is removed by the brush rollers 87 which contacts with the surface of the recording medium. The brush rollers 87 is preferably designed to be rotated so as to enable the brush to move in the travelling direction at the contact area with the recording medium M, and the circumferential speed of the brush rollers 87 is designed to move faster than that of the belt 83 of the conveyor 84 so that the brush rollers 87 actively scratch off the printing material.

The recording medium M is then taken out from the cleaning liquid W with the second conveyor 92, carried to the discharge side on the guide plate 93, and pressurized by the squeezing rollers 96 to squeeze out the cleaning liquid W contained therein. Next, after moving past on the guide plate 94, the recording medium M is heated by the heating rollers 97 and is finally discharged outside by the discharge rollers 76 via the guide plate 95 in almost dried condition.

The suction fan 99 sucks steam of the cleaning liquid W generated in the heating of the recording medium M by the heating rollers 97, steam generated by evaporation of the cleaning liquid W, and steam generated from the cleaning liquid W impregnated in the recording medium M. The steam introduced in the suction fan 99 is delivered to the recovery unit 100, where moisture separated and recovered from steam is sent back to the container 77 via the outlet 105 and an odor is adsorbed and removed by the adsorbent material 104.

Figure 9:
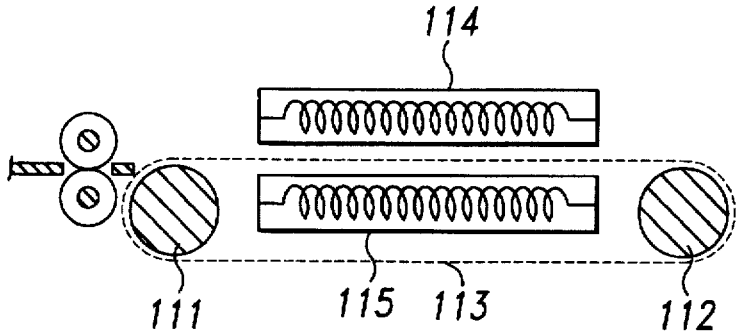
FIG. 9 is a cross sectional plan view showing the other embodiment of the heating and drying device.
Figure 10:
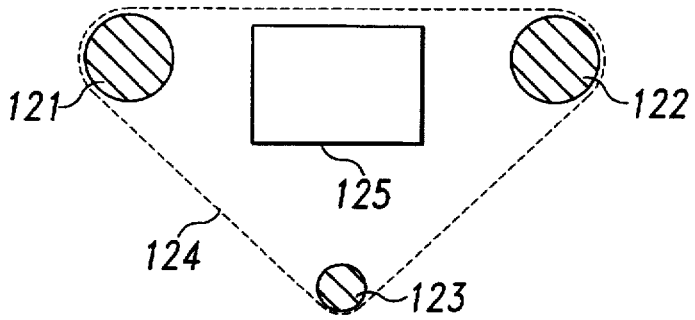
FIG. 10 is a cross sectional plan view showing another embodiment of the heating and drying device.

The equipment for heating and drying the recording medium M is not limited to the roller type heater, but other types of heaters as shown in FIGS. 9 and 10 may be used. The heater shown in FIG. 9 comprises a pair of rollers 111 and 112, a breathable belt 113 entrained about the rollers 111 and 112 which transport the recording medium based on the rotation of the roller 111 or 112, and a pair of heaters 113 and 114 opposing via the belt 113 which heats to dry the recording medium transported by the belt 113. The heater shown in FIG. 10 comprises three rollers 121, 122, and 123, a breathable belt 124 for transporting the recording medium in accordance with the rotation of the roller 121 or 122, and a warm air fan 60 for discharging a warmed air to the recording medium on the belt 124.

Figure 11:
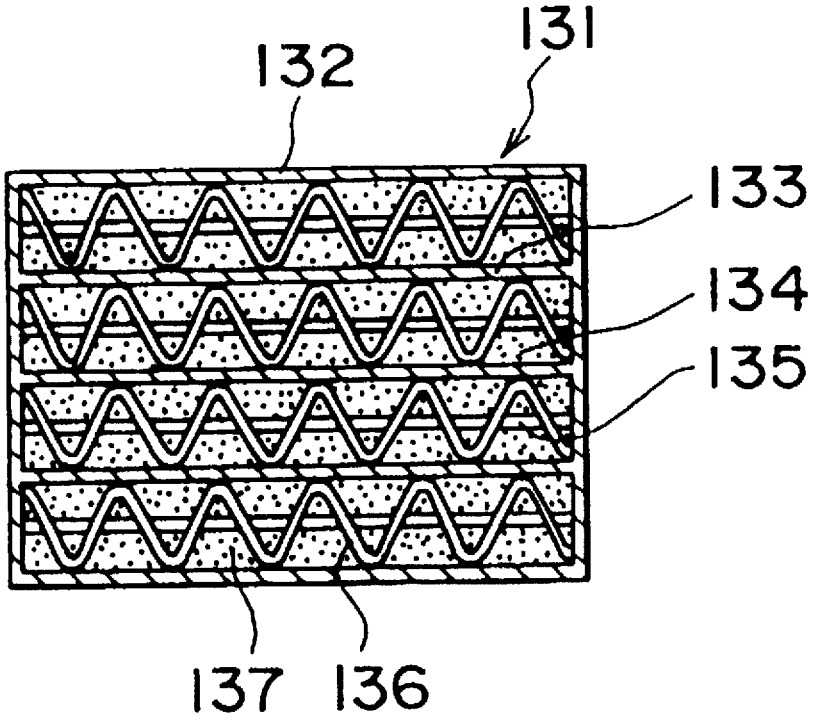
FIG. 11 is a cross sectional plan view showing the other embodiment of the recovery device.

Another recovery unit as shown in FIG. 11 may be employed. In this recovery unit 131, a container 132 is divided into several compartments 133 by partitions 134. Each compartment 133 has an accordion type curtain 136 that stretches along a guide rod 135. Also, a clearance in each curtain 136 is filled with a breathable and stretchable member 137 comprising an adsorbent or containing the same. Therefore, the steam supplied from the suction fan 99 moves past the breathable and stretchable member 137, and is deprived of moisture and odor thereby. The moisture adsorbed in the adsorbent is discharged by folding the curtain 136 along the guide rod 135 to compress the stretchable member 137, and then sent back to the container 77 through the outlet 105.

Although in the embodiments above described the recording medium M is immersed in the cleaning liquid W for the purpose of removing the printing material, the cleaning liquid W may be applied to the recording medium by other application means such as brushes, rollers, and sprays.

Examples of the moisture adsorbing member 104 and 137 include synthesized zeolite (commercially available from Nippon Chemical Industrial Co., Ltd. as "ZEOSTAR"), cellulose beads (NISSHINBO INDUSTRIES INC.), moisture adsorbent resin (commercially available from Nippon Shokubai Company as "AQUALIC AC" and from Sanyo Chemical Industries Ltd. as "SAKULIS"), and moisture adsorbent film (Mitsubishi Plastics Industries Ltd.). Examples of odor adsorbing materials include activated coal (commercially available from Takeda Chemical Industries, Ltd. as granulated "HAKUTAKA") and carbon fiber (commercially available from Toyobo Co., Ltd. as "K FILTER" and Toho Rayon Co., Ltd. as "BESFIGHT").

The cleaning liquid will be described in detail. When the printed portion is removed without pulping the paper, extremely poor print removal effects are achieved by exerting the surfactant alone directly on the recording medium, and a substance that swells the toner is used together to allow the toner to come up from the paper surface. Consequently, it is desirable to use a cleaning liquid that contains at least higher fatty acid ester, surfactant which has a compatibility with water and swells the printing material, and water. Water works to swell pulp fibers of the paper and efficiently remove the printing material, such as toner comprising resin particles which penetrate into the network structure. The water content is 10–90 wt % with respect to the total cleaning liquid, preferably, 20–88 wt %. However, when the water content is less than 1 wt %, there is a case in which effects to expand the fiber are not sufficient. Conversely, when the water content is excessively large, time required for cleaning greatly increases, lowering the cleaning treatment efficiency per unit time. Though it depends on the toner type, when water exceeds 90 wt %, the said time excessively increases and it is not desirable. If the water content is great as seen in this case, the bonding force (hydrogen bond) between fibers is weakened, damaging the paper surface during cleaning with physical force applied and in the extreme case, resulting in trouble to break paper fiber to destroy the paper. It is, therefore, desirable to keep the water content to 30–85 wt %. When the cleaning liquid contains water, the boiling point rises as compared to that of the conventional organic solvent-based ink removing agent and volatility improves. With this effect, toxic gas generation decreases, toxicity lowers, inflammability lowers, stable concentration of other components of the cleaning liquid is achieved, and the quality is difficult to change.

For the swelling agent contained in the cleaning liquid, it is basically desired to have components that scarcely dissolve the resin component of the toner used in the developing device, dye component of the charge controlling agent, etc., and colorant component of pigments, etc., but primarily swell the resin component and convert the toner into gel-form plastic polymers. That is, the regenerating apparatus according to this invention is assumed to be subjected to the largest cleaning volume of the recording medium prepared in the copier 1 to which the regenerating apparatus is to be mounted. For the specific component, it is desirable to include those containing at least higher fatty acid ester, water, and surfactant, and in addition, organic acid.

Next discussion is made on the operation of this component. When the printed recording medium is immersed in the cleaning liquid, the resin component of the toner fixed on the paper or OHP film adsorbs the swelling agent by the action of the said swelling agent and converts to viscous gel-form polymer with high plasticity which can stretch from 0.5 mm to several cm. This viscous gel-form polymer greatly lowers the bonding force to paper fibers or OHP film and is readily liberated only by applying a slight physical (mechanical) stress, and cleaning takes place. The cleaning action depends on the pH of the liquid and in particular, when the toner resin is polyester-based, bringing the liquid pH to weak alkaline of about 8–10 breaks the ester bonding to decompose into fine powders, enabling further easier removal. In addition, the cleaning action depends on the liquid temperature. Consequently, the liquid pH and temperature shall be determined based on these, but it is desirable to adjust the pH to 3.0–11.0 and liquid temperature in the range of 20°–60° C. In order to achieve stable cleaning effects, it is more desirable to use various pH buffers to keep the pH to an optimum constant value. Under the weak acidic condition with pH less than 3.0 or strong alkaline condition with pH exceeding 11.0, swelling action of toner resin by the swelling agent and peeling action are lowered. At the liquid temperature lower than 20° C., the speed of swelling action of the swelling agent lowers and it becomes difficult to achieve sufficient practical cleaning efficiency. In addition, when the liquid temperature exceeds 60° C., transpiration of the liquid is accelerated and heating power increases excessively, resulting in poor economy.

The fatty acid of the suitable higher fatty acid ester as a swelling agent must be saturated or unsaturated fatty acids and examples include lauric acid, myristic acid, palmitic acid, stearic acid, oleic acid, linoleic acid, erucic acid, ricinoleic acid, abietic acid, rosin, coconut oil, linseed oil, beef tallow, whale oil, etc. Higher fatty acid ester is ester of the fatty acid and hydroxy compounds, examples of which include alcohols such as ethanol, n-butanol, etc., polyhydric alcohols such as ethylene glycol, glycerin penaerythritol sorbitol, glycols such as diethylene glycol, dipropylene glycol, polyethylene glycol, etc., and cellosolves such as ethyl cellosolve, butyl cellosolve, etc., but particularly tall oil fatty acid ester is desirable.

Tall oil fatty acid contains oleic acid and linoleic acid at a ratio of about 6 to 4, as well as traces of palmitic acid, stearic acid, and unsaponifiable matter. Examples of alcohols which esterify tall oil fatty acid include ethylene glycol, polyethylene glycol, ethoxyethanol, butoxyethanol, etc., and preferably, butoxyethanol, ethylene glycol, and ethoxyethanol are used. The cleaning liquid of this invention preferably includes the surfactant. The surfactant serves to surround the organic component printing material such as cleaned resin component and prevents the cleaned printing material from re-adhering to the recording medium. Or when the recording medium is paper such as plain paper, the surfactant penetrates in the paper network structure to surround the printing material so that the printing material entering deep in the fiber is easily cleaned.

Examples of surfactants which are preferably added include anionic surfactant, nonionic surfactant, cationic surfactant, amphoteric surfactant, etc. Examples of anionic surfactants include fatty acid salts, alkylsulfate ester salts, alkyl benzensulfonic acid salts, alkyl naphthalene sufonates, alkyl suofosuccinic acid salts, alkyl diphenyl ether disulfonates, alkyl phosphates, polyoxyethylene alkylsulfate ester salts, naphthalene sulfonic acid formalin condensation products, poly carboxylic acid polymer surfactants, etc.

Examples of nonionic surfactants include polyoxyethylene alkylether, polyoxyethylene alkyl arylether, oxyethylene-oxypropylene copolymer, sorbitan fatty acid ester, polyoxyethylene sorbitan fatty acid ester, polyoxyethylene fatty acid ester, glycerol fatty acid ester, polyoxyethylene alkylamine, etc.

Examples of cationic and amphoteric surfactants include alkyl amine salts, quaternary ammonium salts, alkyl betaine, amine oxides, etc. Particularly preferable surfactants are ethylene oxide added type nonionic surfactants, which are expressed with the chemical formula:

$$RO(CH_2CH_2O)nH$$

(R denotes $C_{12}$–$C_{22}$ alkyl group or alkyl phenyl group and n an integer of 1–10). The above surfactants can be used alone or as a mixture of two or more types. It is desirable to add 0.01–10 wt % (preferably, about 1–3 wt %) to the whole cleaning liquid. If it is less than 0.01 wt %, the removed toner is likely to re-adhere to the recording medium. If it is more than 10 wt %, bubbles are generated and it becomes difficult to handle.

The cleaning liquid preferably contains organic acid and must be penetrated in the printing material. The inventors of the present invention have found that the organic acid improves this penetration effects. And improved penetration effects can shorten the cleaning time. The organic acids preferably added are various carboxylic acids, such as simple substance or mixture of two or more types of formic acid, acetic acid, propionic acid, butyric acid, isobutyric acid, pivalic acid, methacrylic acid, acrylic acid, lactic acid, oxalic acid, tartaric acid, benzoic acid, etc. These organic acids are preferably added by 2–15 wt % to the whole cleaning liquid. If the content is less than 2 wt %, the ink removal speed may be slow and if it is more than 15 wt %, the remaining organic acid may work on the recording medium, causing deterioration in quality.

In the cleaning liquid, higher fatty acid ester should be used in the range of 60–5 wt %, preferably 40–20 wt % of the total cleaning liquid. If it is used more than 60 wt %, the solubility to the toner is high and it is likely to re-adhere to the paper, while if it is used in the range less than 5 wt %, the swellability to the toner degrades, resulting in poor cleaning effects.

The cleaning liquid may contain, within the range that would not impair the effects of the present invention, an organic solvent for swelling the toner, such as methanol, ethanol, n-butanol, isopropanol, ethoxyethanol, etc. and a mixture of these with xylene, toluene, acetone, THF, dioxane, dichloromethane, etc. Such cleaning liquid is commercially available from Nagamune Sangyo as "TOSCLEAN D". "TOSCLEAN D" is a water-based detergent and is a light yellow transparent liquid with physical properties of acid number: about 2.1 mgKOH/g, specific gravity: 1.020 (20° C.), and pH: 7±0.5 (15° C.). This cleaning liquid does not contain any fluorine or carbon chloride compounds which are condemned for destroying the ozone layer, and can be used without deteriorating the earth environment. In addition, because it causes low toxicity to the human body and is inflammable (no flash point), it is extremely suited for application to a paper regenerating apparatus in the regular office environment as in the case of this invention.

The recording medium subjected to the cleaning liquid is not particularly limited, but marked cleaning effects are obtained with plain paper or recycled paper with the network structure which has been difficult for cleaning as discussed above as well as with resin films (OHP form). Similarly, the printing material subjected to the cleaning liquid of the present invention may be water-soluble and oil-soluble inks and red seal-ink, or felt-pen markers, and are not particularly limited, but it exhibits excellent cleaning effects for toner particles including resin components which are believed to be particularly difficult to clean.

Now description is made on the toner used in the developing device 6. Examples of the resin component to be used include thermoplastic resins or thermosetting resins such as styrene resin, acrylic resin, methacrylic resin, styrene-acrylic copolymerized resin, styrene-butadiene copolymerized resin, polyester resin, epoxy resin, etc. Or copolymers, block polymers, and graft polymers comprising two or more types of these resins or mixtures of these resins may be used. In these resins, it is preferable to use resins whose number average molecular weight Mn is $1000 \leqq Mn \leqq 20000$, more preferably, $2000 \leqq Mn \leqq 15000$ and weight average molecular weight Mw is $2 \leqq Mw \leqq 80$. It is preferable to use the resin whose glass transition temperature is from 55° to 70° C. and softening point is from 80° to 140° C.

For the colorant, various publicly known pigments and dyes can be used. However, if dyes are used as a colorant, dyes are dissolved in the ink removing agent and re-adhere to the recording medium, possibly reducing the cleaning effects. This kind of inconvenience does not give rise to problems when resin films are used, but when paper with the network structure is used, the pulp fiber of the paper is dyed, creating a serious problem. Consequently, for the colorant of the toner used in the developing device, pigments should be used to prevent the colorant to dissolve during cleaning. Examples of the colorants include carbon black, copper oxide, manganese dioxide, aniline black, activated coal, ferrite, magnetite, etc. for black pigment.

Examples of the yellow pigment include chrome yellow, zinc yellow, cadmium yellow, yellow iron oxide, mineral fast yellow, nickel titanium yellow, navel yellow, naphthol yellow S, Hansa yellow G, Hansa yellow 10G, bendizine yellow-G, bendizine yellow-GR, quinoline yellow lake, permanent yellow NCG, Tartrazine lake, etc.

Examples of the red pigment include red chrome yellow, Molybdenum Orange, Permanent Orange GTR, Pirazolone Orange, Vulcanized Orange, Indanthrene Brilliant Orange RK, Bendizine Orange G, Indanthrene Brilliant Orange GK, red ion oxide, cadmium red, red lead, permanent red 4R, lithol red, pyrazolone red, watching red, lake red C, lake red D, brilliant carmine 6B, eosin lake, rhodamine lake B, alizarin lake, brilliant carmine 3B, vulcanized fast orange GG, permanent red FR4H, permanent carmine FB, etc.

Examples of the blue pigment include iron blue, cobalt blue, alkali blue lake, victoria blue lake, phthalocyanine blue, etc. It is desirable to add 1 to 20 parts by weight of these pigments or colorants, preferably 3 to 15 parts by weight with respect to 100 parts by weight of resin component in the toner.

The toner may contain a charge controlling agent. For the positive charge controlling agent that charges the toner positively, nigrosine base EX, quaternary ammonium salt, polyamine compound, imidasol compound, etc. may be used. For the negative charge controlling agent that charges the toner negatively, chromium complex salt type azo dyes, copper phthalocyanine dyes, chromium complex salts, zinc complex salts, aluminum complex salts, etc. may be used.

It is preferable to add 0.1 to 10 parts by weight, preferably 0.5 to 5 parts by weight of these charge controlling agent with respect to 100 parts by weight of the resin component in the toner. Various types of the above-mentioned charge controlling agents may be used. However, if dye-based charge controlling agents are used, as described in the case of the colorant, dyes may dissolve in the cleaning liquid, re-adhere to the recording medium, and reduce cleaning effects. Consequently, it is desirable to use non-dye based charge controlling agent for the toner to be cleaned or to design to eliminate all charge controlling agents. Or, it is desirable to use charge controlling agents which may be colorless or white even when they dissolve. Or, it is desirable to design the toner resin that has a polar group or functional group and as a charge control resin in which the resin component itself possesses the charge control capabilities.

The toner may contain a offset preventing agent. For the offset preventing agent, low molecular weight polyethylene wax, low molecular weight oxygen convertible polyethylene wax, low molecular weight polypropylene wax, low molecular weight oxygen convertible polypropylene wax, higher fatty acid wax, higher fatty ester wax, sazole wax, etc. may be used alone or as a mixture of two or more types. It is desirable to add 1 to 15 parts by weight, preferably, 2 to 8 parts by weight of these offset preventing agent with respect to 100 parts of resin components in the toner. The toner according to this invention may be designed to be a magnetic toner. The magnetic toner is formed by adding metals exhibiting magnetism such as cobalt, iron, nickel, aluminum, lead, magnesium, zinc, antimony, beryllium, Bismuth, cadmium, calcium, manganese, selenium, titanium, tungsten, banadium, etc., oxides and sinters of these metals, alloys comprised of two or more types of these metals, or mixtures comprised of these metals, oxides, sinters, alloys, etc.

It is desirable to add 1 to 80 parts by weight, preferably, 5 to 60 parts by weight of these magnetic substances with respect to 100 parts by weight of the resin components in the toner. The toner according to this invention may contain a superplasticizer. Examples of the superplasticizer include silica fines, titanium oxide fines, alumina fines, magnesium fluoride fines, silicone carbide fines, boron carbide fines, titanium carbide fines, zirconium carbide fines, titanium nitride fines, zirconium nitride fines, magnetite fines, molybdenum disulfate fines, aluminum stearate fines, magnesium stearate fines, zinc stearate fines, and other various inorganic material fines. These inorganic material fines are desirable to be treated to be hydrophobic with the silane coupling agent, titanium coupling agent, higher fatty acid, or silicon oil.

It is also possible to use various organic materials such as styrene base, acrylic base, methacrylic base, benzo guanamine, silicone, "Teflon", polyethylene, polypropylene, etc. which are granulated by the wet polymerization such as emulsion polymerization, soap-free emulsion polymerization, nonaqueous dispersion polymerization, etc. or vapor phase method. They can also be used in combination with the above-mentioned nonorganic material fines. It is desirable to add 0.05 to 5 parts by weight, preferably 0.1 to 3 parts by weight of these superplasticizers with respect to 100 parts by weight of the resin component in the toner.

Although the present invention has been fully described in connection with the preferred embodiments thereof with reference to the accompanying drawings, it is to be noted that various changes and modifications are apparent to those skilled in the art. Such changes and modifications are to be understood as includes within the scope of the present invention as defined by the appended claims unless they depart therefrom.

What is claimed is:

1. A regenerating apparatus of a recording medium by removing a printing material therefrom, comprising:

a container accommodating a liquid for swelling the printing material;

a holding mechanism which is arranged in the liquid and has a plurality of holding members for holding recording media;

a supplying mechanism which feeds the recording media to the respective holding members successively;

a discharging mechanism which includes a discharging passage extending from said holding mechanism for discharging the recording media having been held by the holding members for a specific time; and a removing member which is at least partly disposed in the liquid and near the passage so as to contact and remove the printing material from the recording media transported along the passage.

2. A regenerating apparatus of recording medium as claimed in claim 1 wherein each of the plurality of holding members comprises a chamber and the chambers of respective holding members are arranged in layers.

3. A regenerating apparatus of recording medium as claimed in claim 2 wherein each chamber holds the recording medium while keeping the recording medium from touching each other.

4. An apparatus for removing a printing material from a recording medium, comprising:

a container which accommodates a liquid for swelling a printing material on a recording medium;

a holding mechanism which is provided in said container to hold a plurality of recording media under the liquid;

a discharging mechanism which discharges the recording media held by said holding mechanism one by one; and a removing member which receives the plurality of recording media discharged by said discharging mechanism under the liquid and removes the printing material from each of the plurality of recording media by contacting therewith.

5. An apparatus as claimed in claim 4, wherein said holding mechanism includes:

a rotatable shaft; and a plurality of chucking mechanisms which are provided to said shaft to hold the recording media, wherein each of said chucking mechanisms travels from a first position at which a chucking mechanism receives the recording medium to a second position at which the chucking mechanism transports the recording medium to the removing member in accordance with rotation of said shaft.

6. An apparatus as claimed in claim 5, wherein each of said chucking mechanisms includes a pair of rollers to chuck the recording medium therebetween.

7. An apparatus as claimed in claim 6, wherein said pair of rollers are separated from each other at the first position to receive the recording medium.

8. An apparatus as claimed in claim 6, wherein said pair of rollers rotates at the second position to transport the recording medium to the removing member.

9. An apparatus as claimed in claim 4, wherein said holding mechanism includes:

a plurality of chambers arranged in layers each of which holds the recording media.

10. An apparatus as claimed in claim 9, wherein each of said chambers has a pair of rollers to transport the recording medium.

11. An apparatus as claimed in claim 4, wherein said removing member includes a pair of brush rollers.

12. An apparatus for removing a printing material from a recording medium, comprising:

containing means for accommodating a liquid, said liquid swelling a printing material on a recording medium;

holding means in the containing means for holding a plurality of recording media under the liquid;

discharging means for discharging the recording media held by said holding means one by one; and removing means for removing the printing material from each of the plurality of recording media by contacting therewith under the liquid.

* * * * *